US005158174A

United States Patent [19]

Hereford

[11] Patent Number: 5,158,174

[45] Date of Patent: Oct. 27, 1992

[54] JEWELRY CONTAINER FOR CREMATION ASHES

[76] Inventor: William M. Hereford, 1202 Hereford Rd., Ruskin, Fla. 33570

[21] Appl. No.: 687,827

[22] Filed: Apr. 19, 1991

[51] Int. Cl.[5] ..... A45C 11/00

[52] U.S. Cl. ..... 206/37; 206/246; 206/446; 206/496; 206/811

[58] Field of Search ..... 206/37, 19, 6.1, 236, 206/246, 269, 446, 496, 811, 38; 27/1

[56] References Cited

U.S. PATENT DOCUMENTS

| | | | |
|---|---|---|---|
| 1,328,988 | 1/1920 | Eckert et al. | 206/811 |
| 1,504,399 | 8/1924 | Thortvedt | 206/37 R |
| 2,009,724 | 7/1935 | Bircher . | |
| 2,276,766 | 3/1942 | De Witt | 206/38 |
| 2,562,726 | 7/1951 | MacDonald | 27/1 |
| 2,751,764 | 6/1956 | Hudes et al. . | |
| 3,621,994 | 11/1971 | Brown | 206/446 |
| 3,819,081 | 6/1974 | Runte | 220/17 |
| 4,118,889 | 10/1978 | Lamlee . | |
| 4,300,578 | 11/1981 | Gershbein . | |
| 4,353,379 | 10/1982 | Castellanos | 206/496 |
| 4,420,076 | 12/1983 | Beveridge et al. | 206/37 |
| 4,756,407 | 7/1988 | Larson | 206/37 |
| 4,866,952 | 9/1989 | Hight et al. | 206/37 |
| 4,942,966 | 7/1990 | Kemp | 206/446 |
| 4,972,684 | 11/1990 | Aitken . | |

FOREIGN PATENT DOCUMENTS

| | | |
|---|---|---|
| 305724 | 5/1917 | Fed. Rep. of Germany . |
| 650144 | 1/1929 | France . |
| 760792 | 3/1934 | France . |

*Primary Examiner*—Jimmy G. Foster
*Assistant Examiner*—Thomas P. Hilliard
*Attorney, Agent, or Firm*—Frijouf, Rust & Pyle

[57] ABSTRACT

An apparatus and method is disclosed for an improved jewelry container for cremation ashes which includes a minor container for filling with cremation ashes having a minor opening and a minor container cap for temporarily and permanently hermetically sealing the cremation ashes within the minor container. The minor container is insertable within a major opening of a decorative major cylindrical container and a major container cap is affixed to the major container to retain the minor container within the major container. A support is secured to the major container for enabling the major container to be suspended by a user.

9 Claims, 3 Drawing Sheets

JEWELRY CONTAINER FOR CREMATION ASHES

BACKGROUND OF THE INVENTION

1. Field Of The Invention

This invention relates to containers and more particularly, to an apparatus and method of making a jewelry container for cremation ashes.

2. Background Of The Invention

In the past, the use of cremation as a final disposition has been widely used in non-Western countries. In recent years, Western countries are now adopting the cremation process, since cremation is found to be more efficient and less costly. Traditionally, the ashes of the deceased after cremation are offered to the next of kin as a final memorial to the cremated deceased. Typically, the ashes are placed in an elaborate urn and displayed in a prominent location.

U.S. Pat. No. 2,009,724 to Bircher and U.S. Pat. No. 2,562,726 to MacDonald et al. illustrate receptacles for ashes and crematorial urns for displaying the final remains of the deceased.

Although others in the prior art have used jewelry, both containing various types of objects, heretofore the prior art is void of a jewelry container specifically adapted for receiving cremation ashes. For example, U.S. Pat. No. 2,751,764 to Hudes et al. and U.S. Pat. No. 4,972,684 to Aitken illustrate jewelry items which are adapted for receiving perfume and the like. U.S. Pat. No. 4,118,889 illustrates a jewelry container for receiving a plant whereas U.S. Pat. No. 4,866,952 illustrates a pendant container for tablets and capsules. Finally, U.S. Pat. No. 4,300,578 to Gershbein illustrates a jewelry smoking device. Although the prior art patents have illustrated various containers depicting a wide variety of objects, heretofore none in the prior art has provided a jewelry container specifically adapted for receiving cremation ashes.

Therefore, it is an object of this invention to provide an improved jewelry container for containing cremation ashes.

Another object of this invention is to provide a jewelry container for receiving cremation ashes wherein the ashes are totally sealed within the jewelry container.

Another object of this invention is to provide a jewelry container for containing cremation ashes wherein the jewelry container comprises an inner and outer container, the inner container of which may be hermetically sealed for containing the cremation ashes and wherein the outer container is a decorative jewelry container.

Another object of this invention is to provide a jewelry container for cremation which may be fabricated without contamination of the cremation ashes.

Another object of this invention is to provide a jewelry container for cremation ashes wherein the cremation ashes are sealed within an inner container of the jewelry container such that the cremation ashes cannot be accidentally released or accidentally tampered with.

Another object of this invention is to provide an improved process for sealing cremation ashes in a jewelry container comprising an inner and outer container which is efficient for the funeral director and for the jeweler.

Another object of this invention is to provide an improved process for placing cremation ashes within a jewelry container wherein the cremation ashes may be shipped in an inner container from the funeral crematorium or the like to a jeweler wherein the inner container is sealed and inserted within an outer decorative container.

The foregoing has outlined some of the more pertinent objects of the present invention. These objects should be construed as being merely illustrative of some of the more prominent features and applications of the invention. Many other beneficial results can be obtained by applying the disclosed invention in a different manner or modifying the invention with in the scope of the invention. Accordingly other objects in a full understanding of the invention may be had by referring to the summary of the invention, the detailed description describing the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention an improved jewelry container for cremation ashes, comprising in combination a minor container having a minor opening and a minor container cap for sealing the minor opening in the minor container The minor opening enabling the minor container to be filled with the cremation ashes and with the minor container cap being insertable into the minor opening of the minor container for temporarily sealing the cremation ashes within the minor container. The minor container cap is affixable to the minor container for permanently hermetically sealing the cremation ashes within the minor container. A decorative major cylindrical container has a major opening for cooperation with a major container cap for the major opening in the major container. The minor container is insertable within the major opening of the decorative major container with the major container cap being affixable to the major container to retain the minor container within the major container. A support is secured to the major container for enabling the major container to be suspended by a user.

In a more specific embodiment of the invention, the minor container cap includes an end plate and an end insert with the end insert being adapted to be frictionally engaged with the minor container for temporarily securing the minor container cap to the minor container. The minor container cap is adapted to be subsequently permanently sealed to the minor container for hermetically sealing the cremation ashes therein.

Preferably, the minor container has a first and a second end defining a minor container length with the minor container being substantially cylindrical defining a minor container inner diameter and a minor container outer diameter. A first minor end wall is secured to the first end of the minor container for sealing the first end thereof enabling the minor container inner diameter to receive the cremation ashes therein. A minor container cap is adapted to temporarily seal the second end of the minor container and being adapted to be subsequently permanently sealed to the minor container for hermetically sealing the cremation ashes therein.

Preferably, the major container has a first and a second end defining a major container length with a first major end wall secured to the first end of the major container for sealing the first end thereof. The major container length of the major container is greater than the minor container length of the minor container. The major container is substantially cylindrical having a major container inner diameter being greater than the minor container outer diameter for enabling the minor container to be received within the major container. A second major end wall is secured to the second end of the major container for retaining the minor container therein. A support is secured to the major container for enabling the major container to be suspended by a user.

The invention is also incorporated into the method of encapsulating cremation ashes within a jewelry container, comprising the steps of fabricating a minor container having a minor opening and fabricating a minor container cap for sealing the minor opening in the minor container. The minor container and the minor container cap are then shipped to a location of the cremation ashes. The minor container is then filled with the cremation ashes and the minor container cap is inserted into the minor opening of the minor container to temporarily seal the cremation ashes within the minor container. The minor container is shipped with the cremation ashes to a jeweler whereat the minor container cap is permanently affixed to the minor container to hermetically seal the cremation ashes within the minor container. A decorative major container is then fabricated having a major opening for receiving the minor container therein. A major container cap is affixed to the major opening to retain the minor container within the major container.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 1:
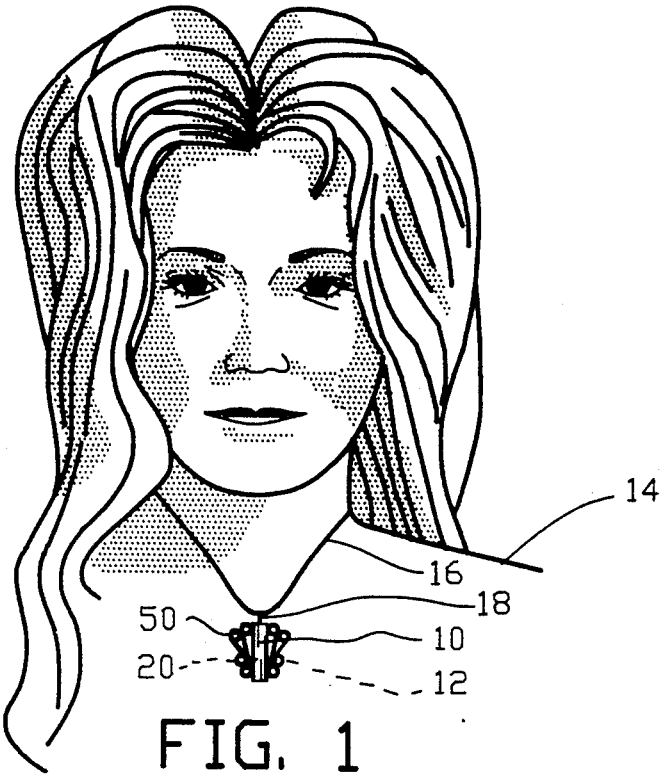
FIG. 1 is an isometric view of an improved jewelry container for cremation ashes of the present invention being suspended from a user.

FIG. 1 is a front view of an improved jewelry container 10 for cremation ashes 12 for wearing by a user 14 by being suspended from a necklace chain 16 through a support 18.

Figure 2:
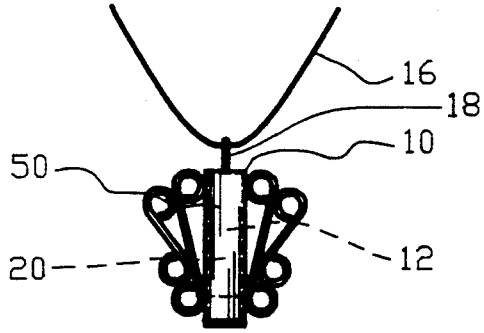
FIG. 2 is a front view of the improved jewelry container of FIG. 1.

FIG. 2 is an enlarged view further illustrating the jewelry container 10 as comprising an inner minor container 20 for holding the cremation ashes 12 disposed within an outer major container 50. The outer major container 50 is shown as a decorative or ornamental jewelry item.

Figure 3:
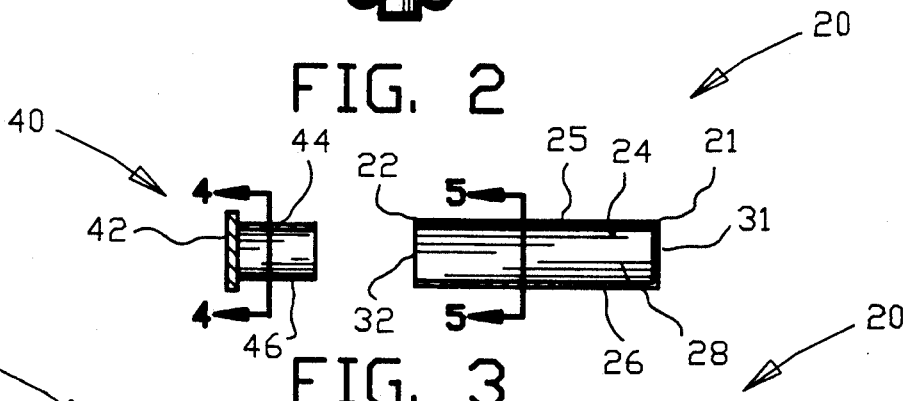
FIG. 3 is a side sectional view of a minor container.
Figure 4:
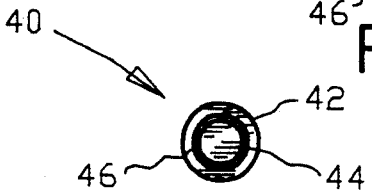
FIG. 4 is a sectional view along line 4—4.
Figure 5:
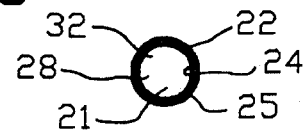
FIG. 5 is a sectional view along line 5—5.

FIGS. 3, 4 and 5 illustrate the minor container 20 as comprising a substantially cylindrical tube extending between a first end 21 and a second end 22 and defining an internal diameter 24 and an external diameter 25. The minor container 20 extends between the first and the second ends 21 and 22 along a minor container length 26 thereby defining a minor internal volume 28. A first minor end wall 31 is secured to the first end 21 of the minor container 20 by means such as soldering, welding, or other means well-known in the jewelry art. A minor container opening 32 is defined in the second end 22 of the minor container 20.

A minor container cap 40 comprises a substantially circular end plate 42 secured to a cylindrical insert 44 defining an outer insert diameter 46. The insert 44 is secured to the circular end plate 42 by means such as soldering, welding or other means well-known in the jewelry art. The circular end plate 42 is affixed to the insert 44 to provide a hermetic or air tight seal therebetween. The outer insert diameter 46 is selected to provide a friction or a press fit with the internal diameter 24 of the minor container 20. In the alternative, treads (not shown) may be defined within the minor internal diameter 24 of the minor container 20 for cooperation with treads (not shown) defined on the insert 44. These methods which should be well-known in the jewelry art are considered to be within the scope of the present invention.

The minor container 20 and the minor container cap 40 are preferably made of a metallic material such as brass, bronze, aluminum or the like. The first minor end wall 31 is secured to the first end 21 of the minor container 20 to provide a hermetic or air tight seal.

Figure 6:
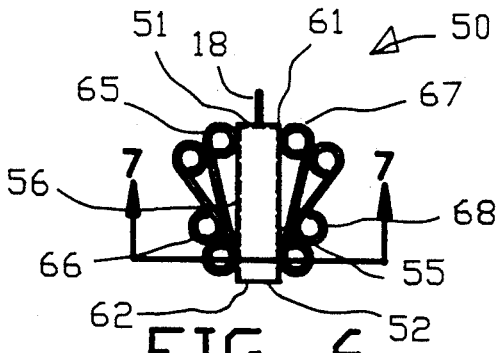
FIG. 6 is a side sectional view of a decorative major container.
Figure 7:
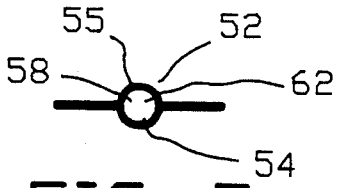
FIG. 7 is a sectional view along line 7—7.

FIGS. 6 and 7 further illustrate the outer major container 50 as comprising a substantially cylindrical tube extending between a first end 51 and a second end 52 defining an internal diameter 54 and an external diameter 55. The major container 50 extends between the first and second ends 51 and 52 along a major container length 56 thereby defining a major internal volume 58. The major container length 56 is greater than the minor container length 26 and with the internal diameter 54 of the major container 50 being slightly greater than the external diameter 25 of the minor container 20. The relationship between the minor container length 26 and the major container length 56 and the external diameter 25 of the minor container 20 and the internal diameter 54 of the major container 50 enables the minor container 20 to be received within the major internal volume 58 of the major container 50.

Preferably, the major container 50 is a decorative container having ornamentation 65–68 secured to the substantially cylindrical major container 50 to provide a decorative jewelry item. The outer major container 50 may be constructed of a precious metallic material such as gold, platinum, silver or the like.

In this embodiment, the support 18 is illustrated as a ring for receiving the necklace chain 16 therein. However, it should be appreciated that other support means such as pins and the like may be incorporated within the present invention.

A first major end wall 61 is secured to the first end 51 of the major container 50 by conventional means of the jewelry art. A major container opening 62 is defined at the second end 52 of the major container 50.

FIGS. 8–13 further illustrate the apparatus of the improved jewelry container 10 as well as the method of encapsulating the cremation ashes 12 within the jewelry container 10.

Figure 8:
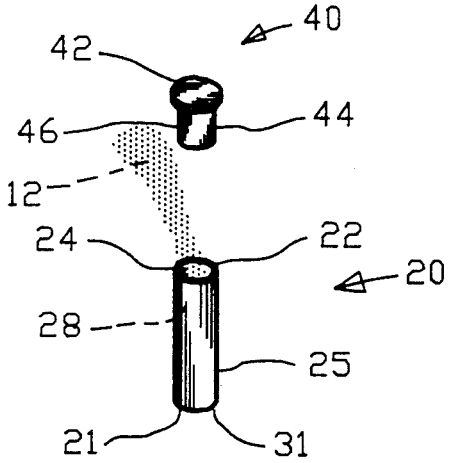
FIG. 8 illustrates the filling of the minor container with cremation ashes.

FIG. 8 illustrates the introduction of cremation ashes 12 through the minor container opening 32 into the minor internal volume 28. The insertion of the cremation ashes 12 within the minor internal volume 28 of the minor container 20 may be accomplished by a licensed funeral director or a licensed crematorium. Preferably, the minor container 20 and the minor container cap 40 are pre-constructed by a jeweler and transferred to the crematorium or funeral director.

Figure 9:
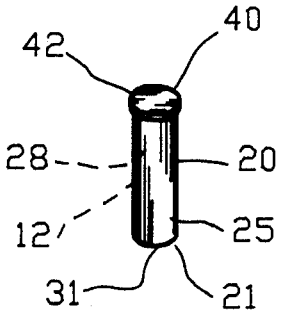
FIG. 9 illustrates the insertion of a minor container cap into the minor opening of the minor container to temporarily seal the cremation ashes within the minor container.

FIG. 9 illustrates the temporary encapsulation of the cremation ashes 12 within the minor internal volume 28 The minor container cap 40 is inserted within the minor container opening 32 enabling the insert 44 to engage with the minor internal diameter 24 of the minor container 20 in a frictional or a press fit. Thereafter, the minor container 20 and minor container cap 40 with the cremation ashes 12 contained therein may be shipped to a jeweler without fear of contamination or introduction of foreign material into the minor internal volume 28 of the minor container 20.

Figure 10:
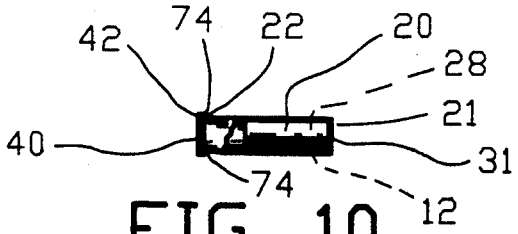
FIG. 10 illustrates the affixing of the minor container cap to the minor container to permanently seal the cremation ashes within the minor container.

FIG. 10 illustrates the step of permanently affixing the minor container cap 40 to the minor container 20. In this embodiment, minor container cap 40 is permanently affixed to the minor container 20 by a metallic fusion process 74 such as soldering welding, or the like the end plate 42 to the minor container 20. It should be appreciated by those skilled in the art that various other methods and means may be employed to permanently affix the minor container cap 40 to the minor container 20.

Figure 11:
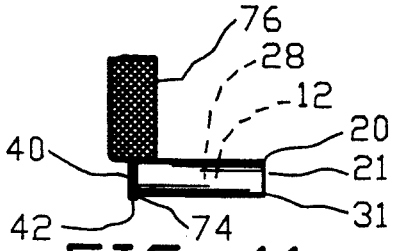
FIG. 11 illustrates the insertion of the minor container within a major opening of a decorative major container.

FIG. 11 illustrates the step of grinding the end plate 42 and any remaining material by a grinding wheel 76. After grinding of the minor container cap 40 and the minor container 20, the minor container 20 has a substantially cylindrical configuration of constant diameter and is hermetically sealed with the cremation ashes 12 being disposed therein.

Figure 12:
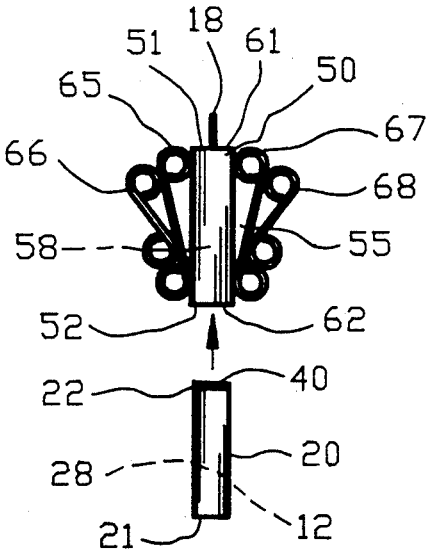
FIG. 12 illustrates the affixing of a major container cap to the major container to retain the minor container within the major container.

FIG. 12 illustrates the step of inserting the hermetically sealed minor container 20 through the major container opening 62 into the major internal volume 58. Since the external diameter 25 of the minor container 20 is slightly less than the internal diameter 54 of the major container 50, the external diameter 25 of the minor container 20 forms a sliding engagement of the internal diameter 54 of the major container 50.

Figure 13:
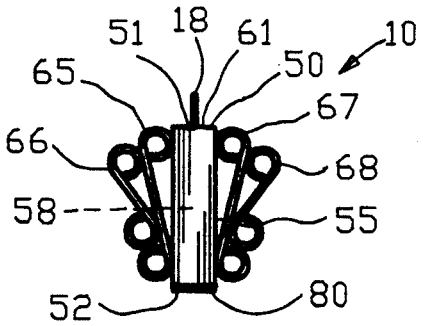
FIG. 13 illustrates the assembled improved jewelry container.

FIG. 13 illustrates the step of affixing a major container cap 80 to the major container opening 62 for retaining the minor container 20 within the major internal volume 58 of the major container 50. The major container cap 80 may be permanently secured by means well-known to the jewelry art or may be secured in a semi-permanent relationship such as with snaps or screw threads or the like. In the event that the snap or screw threads are employed between the major container 50 and the major container cap 80, the minor container 20 may be removed and inserted in a different decorative outer major container (not shown).

An important aspect of the apparatus and method of the present invention is the ability of the present apparatus and method to maintain the cremation ashes 12 free from contamination or introduction of foreign material. The retention of cremation ashes 12 is a solemn practice and accordingly, the introduction of foreign material or the loss of cremation ashes 12 is an indignity to this solemn practice. The present invention enables the cremation ashes 12 to be directly inserted by a funeral director or a crematorium and immediately temporarily sealed in a fast and efficient manner. After transportation to a jeweler, the cremation ashes 12 may be permanently sealed within the minor container 20 without the need to open the minor container 20 thus eliminating the possibility of contamination or the introduction of foreign material. Furthermore, once the minor container 20 is hermetically sealed by the jeweler, the cremation ashes 12 cannot be accidentally released. The present ensures that the cremation ashes 12 may be efficiently encapsulated without the possibility of contamination of the cremation ashes 12.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An improved jewelry container for cremation ashes, comprising in combination:

a minor container having a first and a second end defining a minor container length;

said minor container having a minor opening;

a minor container cap for sealing said minor opening in said minor container;

said minor opening enabling said minor container to be filled with the cremation ashes;

said minor container cap being insertable into said minor opening of said minor container for closing said minor container with the cremation ashes within said minor container;

said minor container cap being metallically fused to said minor container for permanently hermetically sealing the cremation ashes within said minor container and for inhibiting the removal of the cremation ashes therefrom;

a major cylindrical container having a major opening;

a major container cap for said major opening in said major container;

said major container having a major container length being greater than said minor container length of said minor container;

said minor container being insertable within said major opening of said major container;

said major container cap being affixable to said major container to retain said minor container within said major container; and a support secured to said major container for enabling said major container to be suspended by a user.

2. An improved jewelry container for cremation ashes as set forth in claim 1, wherein said minor container cap includes an end plate and an end insert; and said end insert frictionally engaging with said minor container for securing said minor container cap to said minor container.

3. An improved jewelry container for cremation ashes as set forth in claim 1, wherein said minor container cap includes an end plate and an end insert; and said minor container cap being metallically fused to said minor container includes said end plate being metallically fused to said minor container for hermetically sealing the cremation ashes therein.

4. An improved jewelry container for cremation ashes as set forth in claim 1, wherein said minor container cap includes an end plate and an end insert; and said minor container cap being metallically fused to said minor container includes said end plate being soldered to said minor container for hermetically sealing the cremation ashes therein.

5. An improved jewelry container for cremation ashes, comprising in combination:

a minor container having a first and a second end defining a minor container length;

said minor container being substantially cylindrical defining a minor container inner diameter and a minor container outer diameter;

a first minor end wall secured to said first end of said minor container for sealing said first end thereof;

said minor container inner diameter receiving the cremation ashes therein;

a minor container cap closing said second end of said minor container;

said minor container cap being metallically fused to said minor container for hermetically sealing the cremation ashes therein;

a major container having a first and a second end defining a major container length;

a first major end wall secured to said first end of said major container for sealing said first end thereof;

said major container length of said major container being greater than said minor container length of said minor container;

a first major end wall secured to said first end of said major container for sealing said first end thereof;

said major container being substantially cylindrical having a major container inner diameter being greater than said minor container outer diameter for enabling said minor container to be received within said major container;

a second major end wall secured to said second end of said major container for retaining said minor container therein; and a support secured to said major container for enabling said major container to be suspended by a user.

6. An improved jewelry container for cremation ashes as set forth in claim 5, wherein said minor container cap includes an end plate and an end insert; and said end insert being secured to said minor constant inner diameter of said minor container.

7. An improved jewelry container for cremation ashes as set forth in claim 5, wherein said minor container cap includes an end plate and an end insert; and said end insert frictionally engaging with said inner diameter of said minor container for securing said minor container cap to said minor container.

8. An improved jewelry container for cremation ashes as set forth in claim 5, wherein said minor container cap includes an end plate and an end insert; and said minor container cap being metallically fused to said minor container includes said end plate being metallically fused to said minor container for hermetically sealing the cremation ashes therein.

9. An improved jewelry container for cremation ashes as set forth in claim 5, wherein said minor container cap includes an end plate and an end insert; and said minor container cap being metallically fused to said minor container includes said end plate being soldered to said minor container for hermetically sealing the cremation ashes therein.

* * * * *